US009631612B2

(12) United States Patent
Ota et al.

(10) Patent No.: US 9,631,612 B2
(45) Date of Patent: Apr. 25, 2017

(54) VARIABLE DISPLACEMENT TYPE SWASH PLATE COMPRESSOR

(71) Applicant: KABUSHIKI KAISHA TOYOTA JIDOSHOKKI, Kariya-shi, Aichi-ken (JP)

(72) Inventors: Masaki Ota, Kariya (JP); Hiroyuki Nakaima, Kariya (JP); Yusuke Yamazaki, Kariya (JP); Kengo Sakakibara, Kariya (JP); Shinya Yamamoto, Kariya (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 157 days.

(21) Appl. No.: 14/607,462

(22) Filed: Jan. 28, 2015

(65) Prior Publication Data

US 2015/0219082 A1 Aug. 6, 2015

(30) Foreign Application Priority Data

Feb. 3, 2014 (JP) ..... 2014-018506

(51) Int. Cl.
*F04B 27/18* (2006.01)
*F04B 49/12* (2006.01)
(Continued)

(52) U.S. Cl.
CPC ..... *F04B 27/18* (2013.01); *F04B 27/0895* (2013.01); *F04B 27/1804* (2013.01);
(Continued)

(58) Field of Classification Search
CPC ..... F04B 2205/15; F04B 49/22; F04B 49/24; F04B 53/10; F04B 1/295;
(Continued)

(56) References Cited

U.S. PATENT DOCUMENTS 4,932,843 A 6/1990 Itoigawa et al.
6,227,812 B1 * 5/2001 Kawaguchi ..... F04B 27/1804 417/222.2
(Continued)

FOREIGN PATENT DOCUMENTS

EP 0 945 617 B1 9/1999
JP 2009-079530 A 4/2009
JP 2011-149377 A 8/2011

*Primary Examiner* — Dominick L Plakkoottam
(74) *Attorney, Agent, or Firm* — Sughrue Mion, PLLC

(57) ABSTRACT

Setting of the pressure sensing mechanism which controls an opening degree of the first valve body is changed by transmitting driving force of the driving force transmission member to the first valve body via the second valve body. According to this configuration, when the second valve body has been opened while conduction of electricity to the electromagnetic solenoid has been stopped, the refrigerant gas from the discharge chamber is supplied to the control pressure chamber via the passage, the valve chamber, the communication opening, the insertion hole, the first passage, the second passage, the housing chamber, the passage, the second pressure adjusting chamber, the communication hole, the first pressure adjusting chamber, the first shaft inner passage, and the second shaft inner passage.

3 Claims, 5 Drawing Sheets

(51) Int. Cl.

| | |
|---|---|
| ***F04B 49/22*** | (2006.01) |
| ***F04B 27/08*** | (2006.01) |
| ***F04B 39/10*** | (2006.01) |
| ***F04B 53/10*** | (2006.01) |

(52) U.S. Cl.
CPC ..... *F04B 39/10* (2013.01); *F04B 49/12* (2013.01); *F04B 49/22* (2013.01); *F04B 53/1082* (2013.01); *F04B 2027/1813* (2013.01); *F04B 2027/1831* (2013.01)

(58) Field of Classification Search
CPC ..... F04B 2027/1813; F04B 2027/1831; F04B 2027/1854; F04B 27/12; F04B 27/18; F04B 27/1804; F04B 27/1054; F04B 2027/1809; F04B 2027/185; F04C 14/24; F04C 2270/58; F04C 28/24; F04D 15/0005; F04D 15/02; F04D 27/009; F04D 27/0207
USPC ..... 417/222.1, 222.2, 269, 270; 62/498
See application file for complete search history.

(56) References Cited

U.S. PATENT DOCUMENTS

| | | | | |
|---|---|---|---|---|
| 6,382,926 | B2 * | 5/2002 | Ota | F04B 27/1804 417/222.2 |
| 9,010,138 | B2 * | 4/2015 | Yoshida | F04B 11/0091 417/213 |
| 9,228,576 | B2 * | 1/2016 | Yamamoto | F04B 27/18 |
| 9,316,217 | B2 * | 4/2016 | Yamamoto | F04B 27/1804 |
| 2005/0287014 | A1 * | 12/2005 | Umemura | F04B 27/1804 417/222.1 |
| 2009/0220356 | A1 * | 9/2009 | Yamamoto | F04B 27/1804 417/222.1 |
| 2009/0269216 | A1 * | 10/2009 | Ota | F04B 27/1804 417/222.1 |
| 2012/0251343 | A1 * | 10/2012 | Taguchi | F04B 27/1804 417/222.2 |
| 2013/0126017 | A1 * | 5/2013 | Ota | F04B 27/1804 137/487.5 |

* cited by examiner

10
Upper
Lower
Front
Rear
PT
E
50
60
68v
57
53
50c
50s
15
72
32
32v
31
71
31h
14h
70
14
21
32h
31v
14s
12r
30b
30a
12a
12h
12s
12b
12
17a
20
B2
28
29
22
24d
L
19b
19a
13s
19
23b
24e
24a
24
19c
27
26
16
11
23c
24b
24c
23
23a
25
17b
13
13h
B1
17
18

VARIABLE DISPLACEMENT TYPE SWASH PLATE COMPRESSOR

BACKGROUND OF THE INVENTION

The present invention relates to a variable displacement type swash plate compressor in which a piston reciprocally moves by stroke according to an inclination angle of a swash plate.

In general, according to a variable displacement type swash plate compressor, when the pressure in the control pressure chamber becomes high and approaches the pressure in the discharge pressure chamber, the inclination angle of the swash plate decreases, the stroke of the piston becomes small, and the discharge capacity decreases. On the other hand, when the pressure in the control pressure chamber becomes low and approaches the pressure in the suction pressure region, the inclination angle of the swash plate increases, the stroke of the piston becomes large, and the discharge capacity increases. Japanese Laid-Open Patent Publication No. 2009-79530 discloses a variable displacement type swash plate compressor that includes a capacity control valve, and also discloses control of the pressure in the control pressure chamber by the capacity control valve.

According to the compressor disclosed in this literature, conduction of electricity to the electromagnetic solenoid of the capacity control valve is stopped when the air conditioner switch of the vehicle air conditioner has been turned off. At this time, the inclination angle of the swash plate is maintained larger than the minimum inclination angle in some cases due to a variation in the pressure in the suction pressure region. When the air conditioner switch has been turned on again to conduct the electromagnetic solenoid in this state, the discharge capacity suddenly increases and the load to the compressor becomes large. Therefore, it is desirable that the inclination angle of the swash plate have been changed to the minimum inclination angle when conduction of electricity to the electromagnetic solenoid has been stopped by turning off the air conditioner switch.

SUMMARY OF THE INVENTION

An object of the present invention is to provide a variable displacement type swash plate compressor that can change the inclination angle of the swash plate when conduction of electricity to the electromagnetic solenoid has been stopped and that can maintain the minimum inclination angle.

In order to solve the above problem, according to a first aspect of the present invention, there is provided a variable displacement type swash plate compressor that includes: a housing which has a crank chamber; a rotation shaft which is arranged in the housing; a swash plate that is housed in the crank chamber and rotates by driving force from the rotation shaft, an inclination angle of the swash plate with respect to the rotation shaft is changed; a piston that is locked to the swash plate; a control pressure chamber that changes the inclination angle of the swash plate by supply and discharge of a refrigerant gas; and a capacity control valve that controls a pressure in the control pressure chamber. The piston reciprocally moves by a stroke according to the inclination angle of the swash plate. The capacity control valve includes: an electromagnetic solenoid; a driving force transmission member, which is driven by conduction of electricity to the electromagnetic solenoid; a first valve body that controls an opening degree of an intake air passage, which extends from a discharge pressure region to the control pressure chamber, a supply passage is formed in the first valve body and communicates between the discharge pressure region and the control pressure region by bypassing the intake air passage; a second valve body that opens and closes the supply passage by driving force of the driving force transmission member; and a pressure sensing mechanism which is expanded and contracted in a moving direction of the first valve body by sensing a pressure in a suction pressure region to control an opening degree of the first valve body. At a closing time of the second valve body, setting of the pressure sensing mechanism, which controls the opening degree of the first valve body, is changed by transmitting driving force of the driving force transmission member to the first valve body via the second valve body.

DETAILED DESCRIPTION OF THE PREFERRED EMBODIMENTS

Hereinafter, a variable displacement type swash plate compressor that is applied to a compressor used in a vehicle air conditioner according to an embodiment of the present invention will be described with reference to FIGS. 1 to 5. In the following description, an upper and lower direction and a front and rear direction will be define respectively as shown in FIG. 1.

Figure 1:
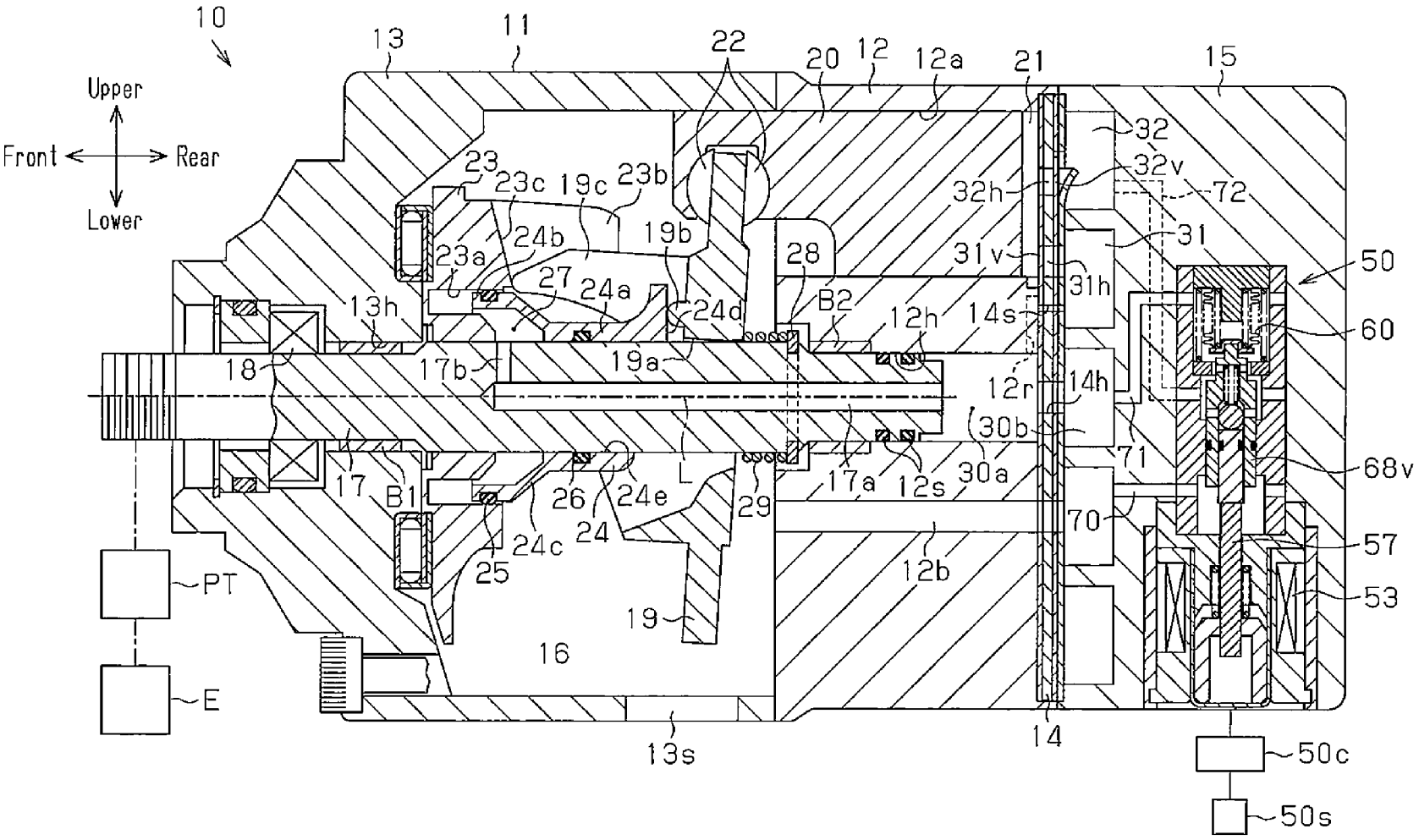
FIG. 1 is a side sectional view of a variable displacement type swash plate compressor according to an embodiment of the present invention.

As shown in FIG. 1, a housing 11 of a variable displacement type swash plate compressor 10 is configured by a cylinder block 12, a front housing 13 that is coupled to a front end of the cylinder block 12, and a rear housing 15 that is coupled to a rear end of the cylinder block 12 via a valve forming member 14. In the housing 11, a crank chamber 16 is formed in the space surrounded by the cylinder block 12 and the front housing 13.

In the housing 11, a rotation shaft 17 having a center axial line L is rotationally supported. The rotation shaft 17 is arranged in the housing 11 by directing both ends in the longitudinal direction to the front and rear direction of the housing 11. The front end of the rotation shaft 17 is inserted into a shaft hole 13*h* formed in the front housing 13, and is also protruded from the front housing 13. The rear end of the rotation shaft 17 is inserted into a shaft hole 12*h* formed in the cylinder block 12.

A first sliding bearing B1 is arranged in the shaft hole 13*h*. The front end of the rotation shaft 17 is rotationally supported to the front housing 13 via the first sliding bearing B1. A second sliding bearing B2 is arranged in the shaft hole 12*h*. The rear end of the rotation shaft 17 is rotationally supported to the cylinder block 12 via the second sliding bearing B2. A lip seal type shaft seal device 18 is present between the front housing 13 and the rotation shaft 17. An engine E of a vehicle is coupled to the front end of the rotation shaft 17 as an external driving power source via a power transmission mechanism PT. The power transmission mechanism PT is an all-time transmission type clutchless mechanism that is configured by combining a belt and a pulley, for example.

A seal ring 12*s* is arranged between the cylinder block 12 and the rotation shaft 17. The seal ring 12*s* seals between a first pressure adjusting chamber 30*a* and the crank chamber 16. The first pressure adjusting chamber 30*a* is a space between the seal ring 12*s* in the shaft hole 12*h* and the valve forming member 14.

A swash plate 19 having an insertion hole 19*a* is housed in the crank chamber 16. The swash plate 19 is installed on the rotation shaft 17 by inserting the rotation shaft 17 into the insertion hole 19*a*. The swash plate 19 rotates by obtaining the driving force from the rotation shaft 17, and can also tilt to an axial direction relative to the rotation shaft 17.

A plurality of cylinder bores 12*a* is formed on the cylinder block 12. The plurality of cylinder bores 12*a* is extended to an axial direction of the cylinder block 12, and is arranged around the rotation shaft 17. FIG. 1 shows only one cylinder bore 12*a*. A piston 20 reciprocates between an upper dead point position and a lower dead point position in each of the plurality of cylinder bores 12*a*. Each cylinder bore 12*a* has an opening that is closed by the valve forming member 14 and an opening that is closed by the piston 20. A compression chamber 21 is formed in each cylinder bore 12*a*. The volume of the compressor chamber 21 changes according to a reciprocal movement of the piston 20. Each piston 20 is locked to the outer peripheral part of the swash plate 19 via a shoe 22. When the rotation shaft 17 has been rotated, the rotation motion of the swash plate 19 is transformed into a reciprocal linear motion of the piston 20 via the shoe 22.

A suction chamber 31 and a discharge chamber 32 are formed between the valve forming member 14 and the rear housing 15. The discharge chamber 32 is arranged to surround the suction chamber 31. On the valve forming member 14, a suction port 31*h*, a suction valve 31*v* that opens and closes the suction port 31*h*, a discharge port 32*h*, and a discharge valve 32*v* that opens and closes the discharge port 32*h* are formed to correspond to each cylinder bore 12*a*. The suction chamber 31 and the compression chamber 21 of each cylinder bore 12*a* are communicated via the suction port 31*h*. The compression chamber 21 of each cylinder bore 12*a* and the discharge chamber 32 are communicated via the discharge port 32*h*.

A second pressure adjusting chamber 30*b* is formed between the valve forming member 14 and the rear housing 15. The second pressure adjusting chamber 30*b* is arranged at the center of the rear housing 15. The suction chamber 31 is arranged at the outer periphery side of the second pressure adjusting chamber 30*b*. A communication hole 14*h* for communicating between the first pressure adjusting chamber 30*a* and the second pressure adjusting chamber 30*b* is formed in the valve forming member 14.

The crank chamber 16 and the suction chamber 31 are communicated with each other by a suction passage 12*b*. The suction passage 12*b* pierces through the cylinder block 12 and the valve forming member 14. A suction opening 13*s* is formed on the circumferential wall of the front housing 13. The suction opening 13*s* is connected to an external refrigerant circuit. A refrigerant gas is suctioned into the crank chamber 16 from the external refrigerant circuit via the suction opening 13*s*, and is thereafter suctioned into the suction chamber 31 via the suction passage 12*b*. Therefore, pressures in the suction chamber 31 and the crank chamber 16 become substantially equal, and the suction chamber 31 and the crank chamber 16 become a suction pressure region.

A lug plate 23 is fixed to the front of the swash plate 19 in the rotation shaft 17. The lug plate 23 is formed into a disk-shaped, and can be rotated together with the rotation shaft 17. A bottomed cylindrical movable body 24 is arranged between the lug plate 23 and the swash plate 19. The movable body 24 can move in the axial direction of the rotation shaft 17 relative to the lug plate 23.

The movable body 24 is formed of a first cylinder part 24*a*, a second cylinder part 24*b*, and a ring-shaped coupling part 24*c* that couples the first cylinder part 24*a* and the second cylinder part 24*b*. The first cylinder part 24*a* has an insertion hole 24*e* into which the rotation shaft 17 is inserted. The second cylinder part 24*b* is extended to the axial direction of the rotation shaft 17 and also has a diameter larger than that of the first cylinder part 24*a*. A ring-shaped guide groove 23*a* is formed on the lug plate 23. The front end of the second cylinder part 24*b* is arranged in the guide groove 23*a* of the lug plate 23. The front end of the second cylinder part 24*b* is slidable on the surface of the guide groove 23*a* opposite to the outer peripheral surface of the second cylinder part 24*b*. Accordingly, the movable body 24 can rotate together with the rotation shaft 17 via the lug plate 23. The interface between the outer peripheral surface of the second cylinder part 24*b* and the surface of the guide groove 23*a* is sealed with a seal member 25. The interface between the insertion hole 24*e* of the movable body 24 and the rotation shaft 17 is sealed with a seal member 26. A control pressure chamber 27 is formed between the lug plate 23 and the movable body 24.

A convex part 19*b* is provided in projection at a portion of the swash plate 19 opposite to the movable body 24. The surface of the first cylinder part 24*a* opposite to the convex part 19*b* forms a pressing surface 24*d* that is in contact with the convex part 19*b* and that presses the swash plate 19.

On the lug plate 23, a pair of arms 23*b* is provided to project toward the swash plate 19. Near the upper end of the swash plate 19, a projection 19*c* is provided to project toward the lug plate 23. The projection 19*c* is inserted into between the pair of arms 23*b*. The projection 19*c* can move between the pair of arms 23*b* in the state that the projection 19*c* is sandwiched between the pair of arms 23*b*. A cam surface 23*c* is formed on the bottom part between the pair of arms 23*b*. The front end of the projection 19*c* can be in slide contact on the cam surface 23*c*. The swash plate 19 can tilt toward the axial direction of the rotation shaft 17 by linkage of the projection 19*c* sandwiched by the pair of arms 23*b* and the cam surface 23*c*. The swash plate 19 rotates based on the transmission of the driving force of the rotation shaft 17 to the projection 19*c* via the pair of arms 23*b*. Because the projection 19*c* moves by sliding on the cam surface 23*c*, the swash plate 19 tilts toward the axial direction of the rotation shaft 17.

A regulating ring 28 is installed between the swash plate 19 of the rotation shaft 17 and the cylinder block 12. A spring 29 is installed between the regulating ring 28 of the rotation shaft 17 and the swash plate 19. The spring 29 biases the swash plate 19 so as to tilt the swash plate 19 toward the lug plate 23.

A first shaft inner passage 17*a* that is extended to the axial direction of the rotation shaft 17 is formed on the rotation shaft 17. The rear end of the first shaft inner passage 17*a* is opened in the first pressure adjusting chamber 30*a*. Further, in the rotation shaft 17, a second shaft inner passage 17*b* extended to the radial direction of the rotation shaft 17 is formed. The lower end of the second shaft inner passage 17*b* is communicated to the front end of the first shaft inner passage 17*a*, and the upper end of the second shaft inner passage 17*b* is communicated to the control pressure chamber 27. Therefore, the control pressure chamber 27 is communicated with the first pressure adjusting chamber 30*a* via the first shaft inner passage 17*a* and the second shaft inner passage 17*b*.

A throttling part 14*s* communicated to the suction chamber 31 is formed on the valve forming member 14. The throttling part 14*s* is a hole that pierces through the valve forming member 14. On the end surface of the cylinder block 12 that faces the valve forming member 14, there is formed a communication concave part 12*r* that communicates between the first pressure adjusting chamber 30*a* and the throttling part 14*s*. The control pressure chamber 27 is communicated with the suction chamber 31, via the second shaft inner passage 17*b*, the first shaft inner passage 17*a*, the first pressure adjusting chamber 30*a*, the communication concave part 12*r*, and the throttling part 14*s*. Accordingly, the second shaft inner passage 17*b*, the first shaft inner passage 17*a*, the first pressure adjusting chamber 30*a*, the communication concave part 12*r*, and the throttling part 14*s* form a bleeding passage from the control pressure chamber 27 to the suction chamber 31. The opening degree of the bleeding passage is throttled by the throttling part 14*s*.

The pressure in the control pressure chamber 27 is controlled by the supply of a refrigerant gas from the discharge chamber 32 to the control pressure chamber 27 and by the discharge of the refrigerant gas from the control pressure chamber 27 to the suction chamber 31. That is, the refrigerant gas supplied to the control pressure chamber 27 is a control gas that controls the pressure in the control pressure chamber 27. The movable body 24 moves to the axial direction of the rotation shaft 17 relative to the lug plate 23, based on the difference between the pressure in the control pressure chamber 27 and the pressure in the crank chamber 16. An electromagnetic system capacity control valve 50 that controls the pressure in the control pressure chamber 27 is built in the rear housing 15. The capacity control valve 50 is electrically connected to a control computer 50*c*. An air conditioner switch 50*s* is signal-connected to the control computer 50*c*.

Figure 2:
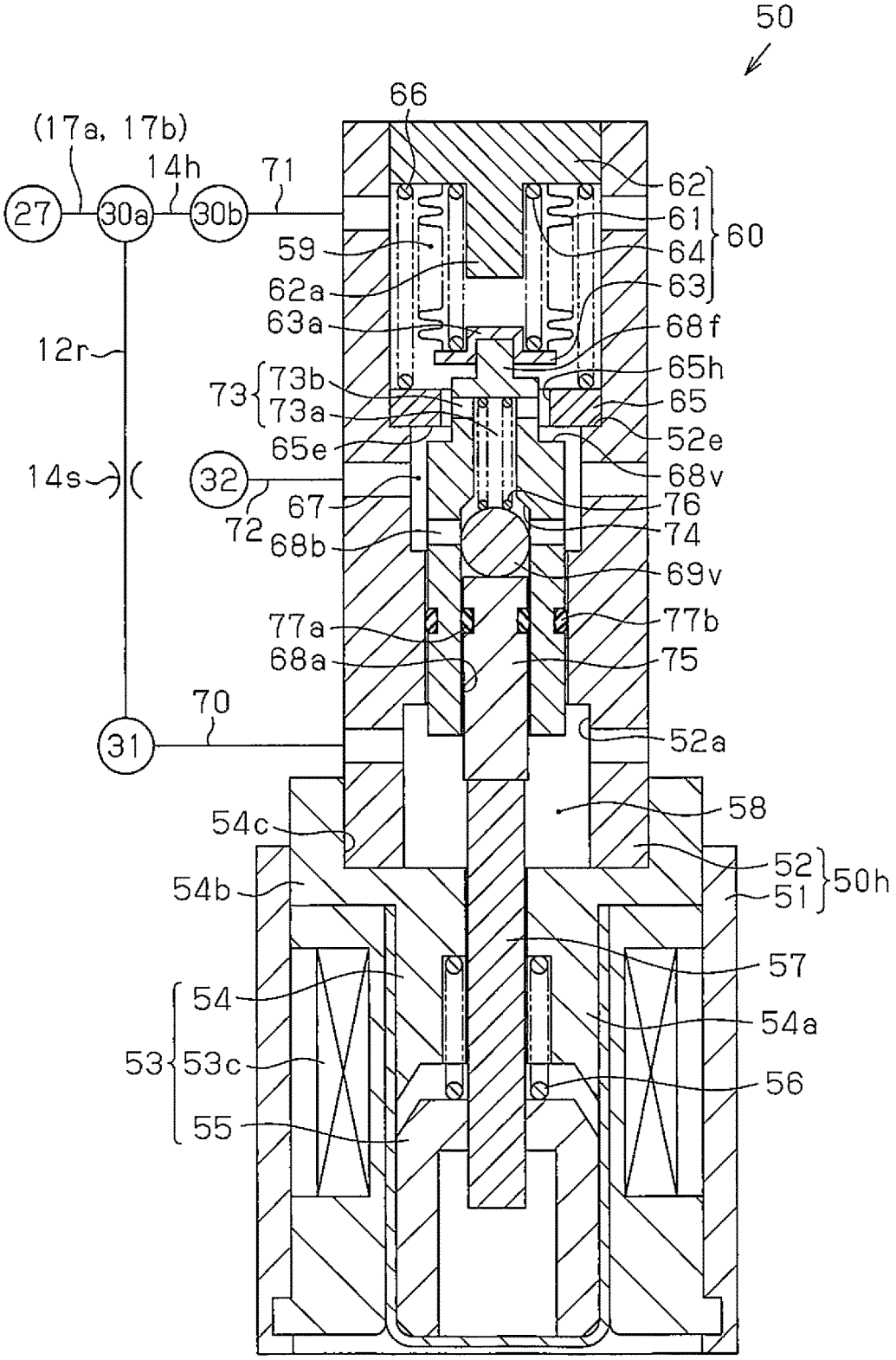
FIG. 2 is a sectional view of a capacity control valve when an inclination angle of a swash plate is a minimum inclination angle.

As shown in FIG. 2, a valve housing 50*h* of the capacity control valve 50 has a cylindrical first housing 51 that houses an electromagnetic solenoid 53. The electromagnetic solenoid 53 has a coil 53*c*, a fixed iron core 54, and a variable iron core 55. The variable iron core 55 is pulled to the fixed iron core 54, based on excitation of current supply to the coil 53*c*. That is, electromagnetic force of the electromagnetic solenoid 53 acts to pull the variable iron core 55 to the fixed iron core 54. The electromagnetic solenoid 53 operates by receiving an electrical conduction control of the control computer 50*c*, specifically, by receiving a duty ratio control. A spring 56 is arranged between the fixed iron core 54 and the variable iron core 55. The spring 56 biases the variable iron core 55 to a direction of separating the variable iron core 55 from the fixed iron core 54.

A pole-shaped driving force transmission member 57 is installed on the variable iron core 55. The driving force transmission member 57 is movable together with the variable iron core 55. The fixed iron core 54 has a small diameter part 54*a* and a large diameter part 54*b* having a larger diameter than that of the small diameter part 54*a*. The small diameter part 54*a* is arranged at the inner side of the coil 53*c*. The large diameter part 54*b* is protruded from the opening of the first housing 51 at the opposite side of the variable iron core 55. A fitting concave part 54*c* is formed on the end surface of the large diameter part 54*b* at the opposite side of the small diameter part 54*a*. A cylindrical second housing 52 is fitted and fixed to the fitting concave part 54*c*.

A housing chamber 59 is formed at the opposite side of the electromagnetic solenoid 53 in the second housing 52. A pressure sensing mechanism 60 is housed in the housing chamber 59. The pressure sensing mechanism 60 is configured by a bellows 61, a pressure receiving body 62 that is coupled to the upper end of the bellows 61, a couple body 63 that is coupled to the other end of the bellows 61, and a spring 64 that is arranged in the bellows 61. The pressure receiving body 62 is pressed to the opening of the second housing 52 at the opposite side of the first housing 51. The spring 64 biases the couple body 63 to a direction of separating the couple body 63 from the pressure receiving body 62.

A stopper 62*a* is integrally formed on the pressure receiving body 62. The stopper 62*a* is arranged in the bellows 61. A stopper 63*a* is also formed on the couple body 63. The stopper 63*a* is protruded toward the stopper 62*a* of the pressure receiving body 62. The stopper 62*a* of the pressure receiving body 62 and the stopper 63*a* of the couple body 63 regulate a shortest length of the bellows 61.

A ring-shaped valve seat member 65 is arranged at the opposite side of the pressure receiving body 62 in the housing chamber 59. In the housing chamber 59, a biasing spring 66 is arranged between the valve seat member 65 and the pressure receiving body 62. A staged part 52*e* is formed on the inner peripheral surface of the second housing 52. The valve seat member 65 is positioned by being pressed against the staged part 52*e* of the second housing 52 by the biasing spring 66. A valve hole 65*h* is formed at the center of the valve seat member 65.

A concave part 52*a* is formed on the end surface of the second housing 52 that faces the fitting concave part 54*c*. A rear pressure chamber 58 is formed between the concave part 52*a* and the fitting concave part 54*c*. The rear pressure chamber 58 is communicated with the suction chamber 31 via a passage 70.

The driving force transmission member 57 is projected in the rear pressure chamber 58 by piercing through the fixed iron core 54. A first valve body 68*v* is housed between the valve seat member 65 in the second housing 52 and the electromagnetic solenoid 53. The first valve body 68*v* is brought into contact with and is separated from the surrounding of the valve hole 65*h* of the valve seat member 65. That is, the surrounding of the valve hole 65*h* on the end surface of the valve seat member 65 that faces the surface of the first valve body 68*v* is the valve seat 65*e* on which the first valve body 68*v* is seated. The valve hole 65*h* is opened and closed based on contact and separation of the first valve body 68*v* to and from the valve seat 65*e*. A valve chamber 67 that is communicated to the valve hole 65*h* is formed in the second housing 52. The first valve body 68*v* is arranged in the valve chamber 67.

An insertion hole 68*a* is formed near the rear pressure chamber 58 of the first valve body 68*v*. The insertion hole 68*a* is extended along a moving direction of the driving force transmission member 57. On the first valve body 68*v*, there is formed a communication opening 68*b* that communicates between the insertion hole 68*a* and the valve chamber 67. The communication opening 68*b* is extended to a direction orthogonal with a moving direction of the driving force transmission member 57. The lower end part of the insertion hole 68*a* is opened to the rear pressure chamber 58.

The upper end part of the insertion hole 68*a* is communicated to the communication opening 68*b*.

A transmission rod 75 is inserted into the insertion hole 68*a*. A second valve body 69*v* is housed in the insertion hole 68*a*. The second valve body 69*v* is arranged on the transmission rod 75 at the opposite side of the driving force transmission member 57. The lower end of the transmission rod 75 is in contact with the driving force transmission member 57. The upper end of the transmission rod 75 is in contact with the second valve body 69*v*.

A communication path 73 that communicates between the insertion hole 68*a* and the housing chamber 59 is formed near the housing chamber 59 of the first valve body 68*v*. The communication path 73 is configured by a first passage 73*a* and a second passage 73*b*. The first passage 73*a* is extended along the axial direction of the first valve body 68*v*. The lower end part of the first passage 73*a* is communicated to the insertion hole 68*a*. The second passage 73*b* is communicated to the upper end part of the first passage 73*a* and is also extended to a direction orthogonal with the first passage 73*a*. The second passage 73*b* is also communicated to the housing chamber 59. The hole diameter of the first passage 73*a* is smaller than the hole diameter of the insertion hole 68*a*. Therefore, a staged part 74 is formed between the insertion hole 68*a* and the first passage 73*a*.

The second valve body 69*v* opens and closes the first passage 73*a* by being brought into contact with or being separated from the staged part 74. Therefore, the staged part 74 is a valve seat on which the second valve body 69*v* is seated. A biasing spring 76 as a biasing member is arranged in the first passage 73*a*. The biasing spring 76 biases the second valve body 69*v* toward the transmission rod 75. The biasing spring 76 is arranged between the first valve body 68*v* and the second valve body 69*v*.

A pole-type projection part 68*f* is formed on the end surface of the first valve body 68*v* near the housing chamber 59. The projection part 68*f* is coupled to the couple body 63. Therefore, the first valve body 68*v* is integrated with the pressure sensing mechanism 60. A seal member 77*a* that seals between the communication opening 68*b* and the rear pressure chamber 58 is mounted on the outer peripheral surface of the transmission rod 75. A seal member 77*b* that seals between the valve chamber 67 and the rear pressure chamber 58 is mounted on the outer peripheral surface of the first valve body 68*v*.

The housing chamber 59 is communicated to the second pressure adjusting chamber 30*b* via the passage 71. The valve chamber 67 is communicated to the discharge chamber 32 via the passage 72. Accordingly, the passage 72, the valve chamber 67, the valve hole 65*h*, the housing chamber 59, the passage 71, the second pressure adjusting chamber 30*b*, the communication hole 14*h*, the first pressure adjusting chamber 30*a*, the first shaft inner passage 17*a*, and the second shaft inner passage 17*b* form an intake air passage that extends from the discharge chamber 32 to the control pressure chamber 27.

The sectional area of the valve hole 65*h* that is opened and closed by the first valve body 68*v* is the same as the effective pressure receiving area of the bellows 61. Accordingly, in the closed state of the first valve body 68*v*, the pressure sensing mechanism 60 does not receive the influence of the pressure in the housing chamber 59. The bellows 61 is contracted and expanded to a moving direction of the first valve body 68*v*, by sensing the pressure applied to the first valve body 68*v* in the rear pressure chamber 58. The contraction and expansion of the bellows 61 is utilized for positioning the first valve body 68*v*, and contributes to the opening degree of the first valve body 68*v*. The opening degree of the first valve body 68*v* is determined by the balance of the electromagnetic force that is generated by the electromagnetic solenoid 53, the biasing force of the spring 56 and the biasing force of the pressure sensing mechanism 60.

The first valve body 68*v* controls the opening degree of the intake air passage, that is, the passing sectional area. When the first valve body 68*v* has seated on the valve seat 65*e*, the intake air passage is closed and the first valve body 68*v* becomes in the closed state. When the first valve body 68*v* is separated from the valve seat 65*e*, the intake air passage is opened and the first valve body 68*v* becomes in the opened state.

The valve chamber 67 is communicated with the housing chamber 59, via the communication opening 68*b*, the insertion hole 68*a*, the first passage 73*a*, and the second passage 73*b*. Therefore, the communication opening 68*b*, the insertion hole 68*a*, the first passage 73*a*, and the second passage 73*b* are formed in the first valve body 68*v* and form a supply passage that communicates between the discharge chamber 32 and the control pressure chamber 27.

When the second valve body 69*v* has been brought into contact with the staged part 74 against the biasing force of the biasing spring 76, the supply passage is closed and the second valve body 69*v* becomes in the closed state. When the second valve body 69*v* has been separated from the staged part 74 by the biasing force of the biasing spring 76, the supply passage is opened and the second valve body 69*v* becomes in the opened state.

Figure 3:
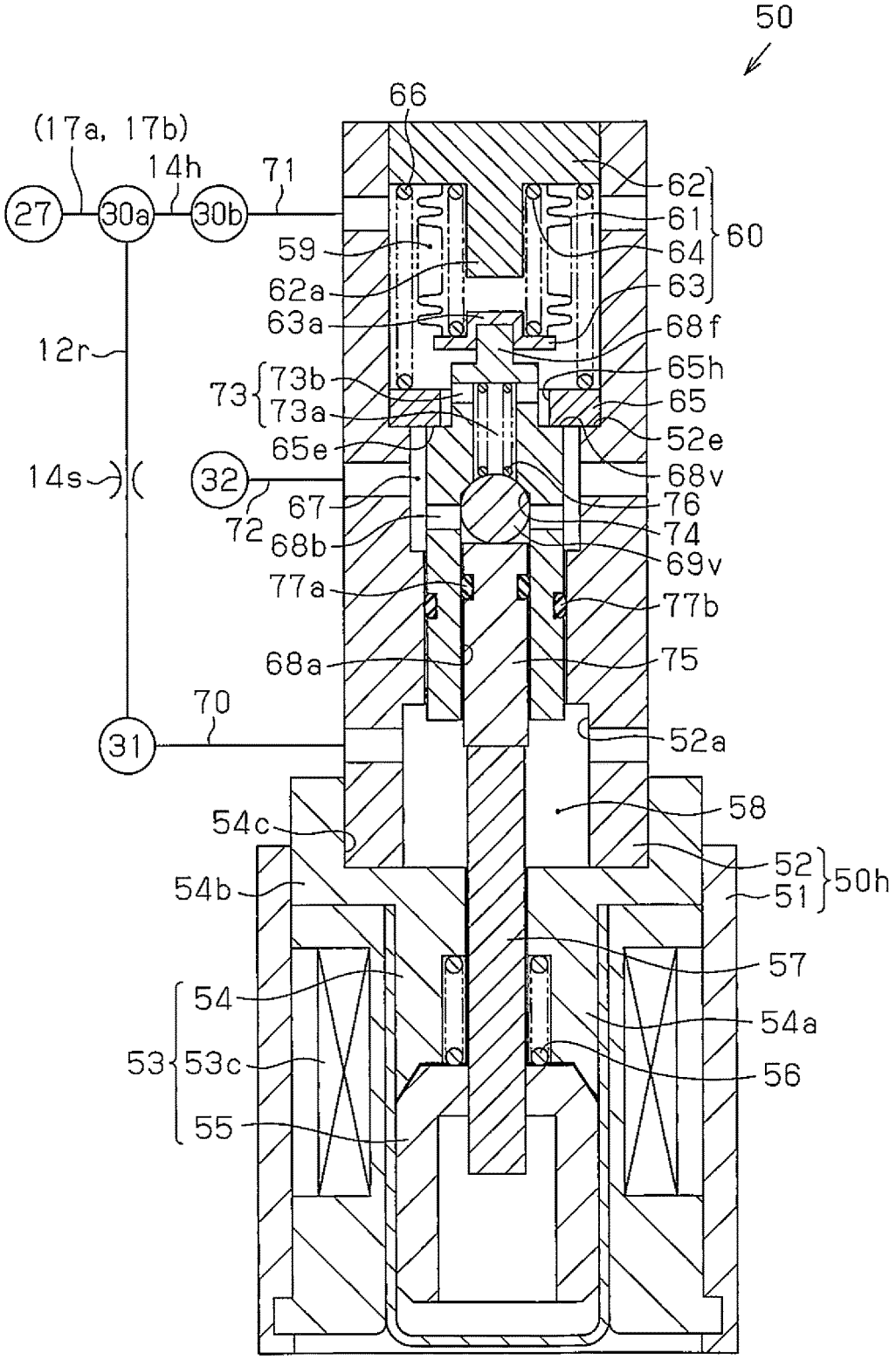
FIG. 3 is a sectional view of the capacity control valve when the inclination angle of the swash plate is a maximum inclination angle.

As shown in FIG. 3, in the variable displacement type swash plate compressor 10, when the electromagnetic solenoid 53 has been conducted by turning on the air conditioner switch 50*s*, the variable iron core 55 is pulled to the fixed iron core 54, against the spring force of the spring 56. Then, the driving force transmission member 57 presses the transmission rod 75, and also the transmission rod 75 presses the second valve body 69*v*. At this time, when the pressing force from the transmission rod 75 is stronger than the biasing force of the biasing spring 76, the second valve body 69*v* moves toward the staged part 74. When the second valve body 69*v* has been brought into contact with the staged part 74, the second valve body 69*v* becomes in the closed state. Accordingly, there is performed regulation of the refrigerant gas which is supplied from the discharge chamber 32 to the control pressure chamber 27 via the passage 72, the valve chamber 67, the communication opening 68*b*, the insertion hole 68*a*, the first passage 73*a*, the second passage 73*b*, the housing chamber 59, the passage 71, the second pressure adjusting chamber 30*b*, the communication hole 14*h*, the first pressure adjusting chamber 30*a*, the first shaft inner passage 17*a*, and the second shaft inner passage 17*b*.

By the pressing force that acts from the second valve body 69*v* to the stage part 74, the first valve body 68*v* moves toward the valve seat member 65, and the opening degree of the first valve body 68 decreases. Accordingly, the flow volume of the refrigerant gas decreases that is supplied from the discharge chamber 32 to the control pressure chamber 27 via the passage 72, the valve chamber 67, the valve hole 65*h*, the housing chamber 59, the passage 71, the second pressure adjusting chamber 30*b*, the communication hole 14*h*, the first pressure adjusting chamber 30*a*, the first shaft inner passage 17*a*, and the second shaft inner passage 17*b*. Then, the pressure in the control pressure chamber 27 approaches the pressure in the suction chamber 31, based on the discharge of the refrigerant gas from the control pressure chamber 27 to the suction chamber 31 via the second shaft inner passage 17*b*, the first shaft inner passage 17*a*, the first pressure adjusting chamber 30*a*, the communication concave part 12*r*, and the throttling part 14*s*.

That is, in the present embodiment, at the closing time of the second valve body 69*v*, the driving force of the driving force transmission member 57 is transmitted to the first valve body 68*v* via the second valve body 69*v*, so that the setting of the pressure sensing mechanism 60 that controls the opening degree of the first valve body 68*v* is changed.

Figure 4:
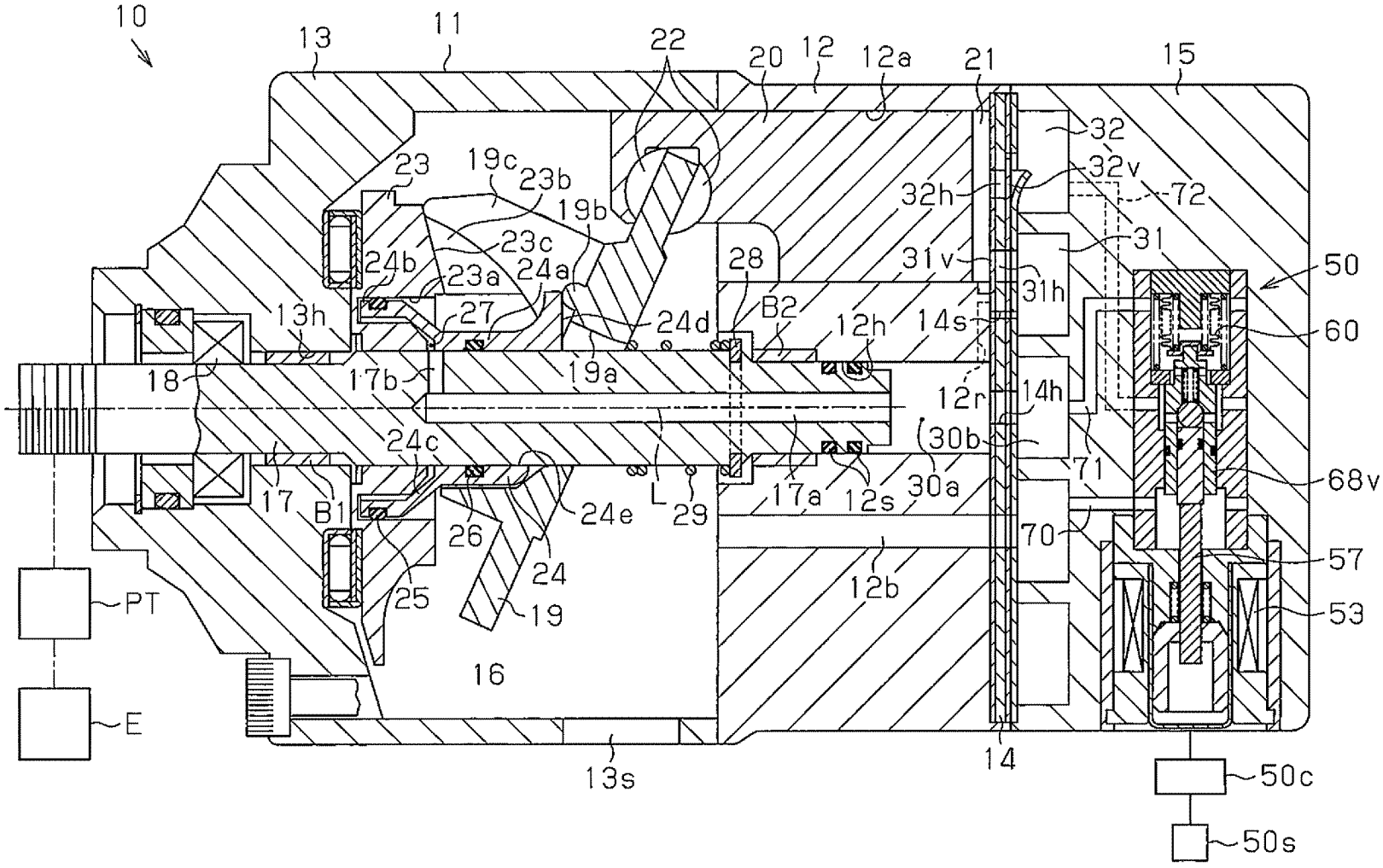
FIG. 4 is a side sectional view of the variable displacement type swash plate compressor when the inclination angle of the swash plate is the maximum inclination angle.

As shown in FIG. 4, when the difference between the pressure in the control pressure chamber 27 and the pressure in the crank chamber 16 becomes small based on the approach of the pressure in the control pressure chamber 27 to the pressure in the suction chamber 31, the movable body 24 moves to a direction of making the first cylinder part 24*a* approach the lug plate 23. Then, the swash plate 19 is biased toward the lug plate 23 by the spring 29, and the projection 19*c* moves by sliding on the cam surface 23*c* and is separated from the rotation shaft 17. Accordingly, the inclination angle of the swash plate 19 becomes large and the stroke of the piston 20 becomes large. As a result, the discharge capacity increases.

As shown in FIG. 2, the opening degree of the first valve body 68*v* increases when the excess current to the electromagnetic solenoid 53 has been stopped by turning off the air conditioner switch 50*s*. Accordingly, the flow volume of the refrigerant gas increases that is supplied from the discharge chamber 32 to the control pressure chamber 27 via the passage 72, the valve chamber 67, the valve hole 65*h*, the housing chamber 59, the passage 71, the second pressure adjusting chamber 30*b*, the communication hole 14*h*, the first pressure adjusting chamber 30*a*, the first shaft inner passage 17*a*, and the second shaft inner passage 17*b*.

Further, the second valve body 69*v* is separated from the staged part 74 by the biasing force of the biasing spring 76, and the second valve body 69*v* is opened. Then, the refrigerant gas is supplied from the discharge chamber 32 to the control pressure chamber 27 via the passage 72, the valve chamber 67, the communication opening 68*b*, the insertion hole 68*a*, the first passage 73*a*, the second passage 73*b*, the housing chamber 59, the passage 71, the second pressure adjusting chamber 30*b*, the communication hole 14*h*, the first pressure adjusting chamber 30*a*, the first shaft inner passage 17*a*, and the second shaft inner passage 17*b*. Accordingly, the pressure in the control pressure chamber 27 approaches the pressure in the discharge chamber 32.

As shown in FIG. 1, when the difference between the pressure in the control pressure chamber 27 and the pressure in the crank chamber 16 becomes large based on the approach of the pressure in the control pressure chamber 27 to the pressure in the discharge chamber 32, the movable body 24 moves to a direction of making the first cylinder part 24*a* separated from the lug plate 23. Then, the pressing surface 24*d* of the first cylinder part 24*a* presses the convex surface 19*b*. Therefore, the swash plate 19 is separated from the lug plate 23 against the biasing force of the spring 29, and the projection 19*c* moves by sliding on the cam surface 23*c* and approaches the rotation shaft 17. Accordingly, the inclination angle of the swash plate 19 becomes small and the stroke of the piston 20 becomes small. As a result, the discharge capacity decreases.

Next, an operation of the variable displacement type swash plate compressor 10 will be described with reference to FIG. 5.

Figure 5:
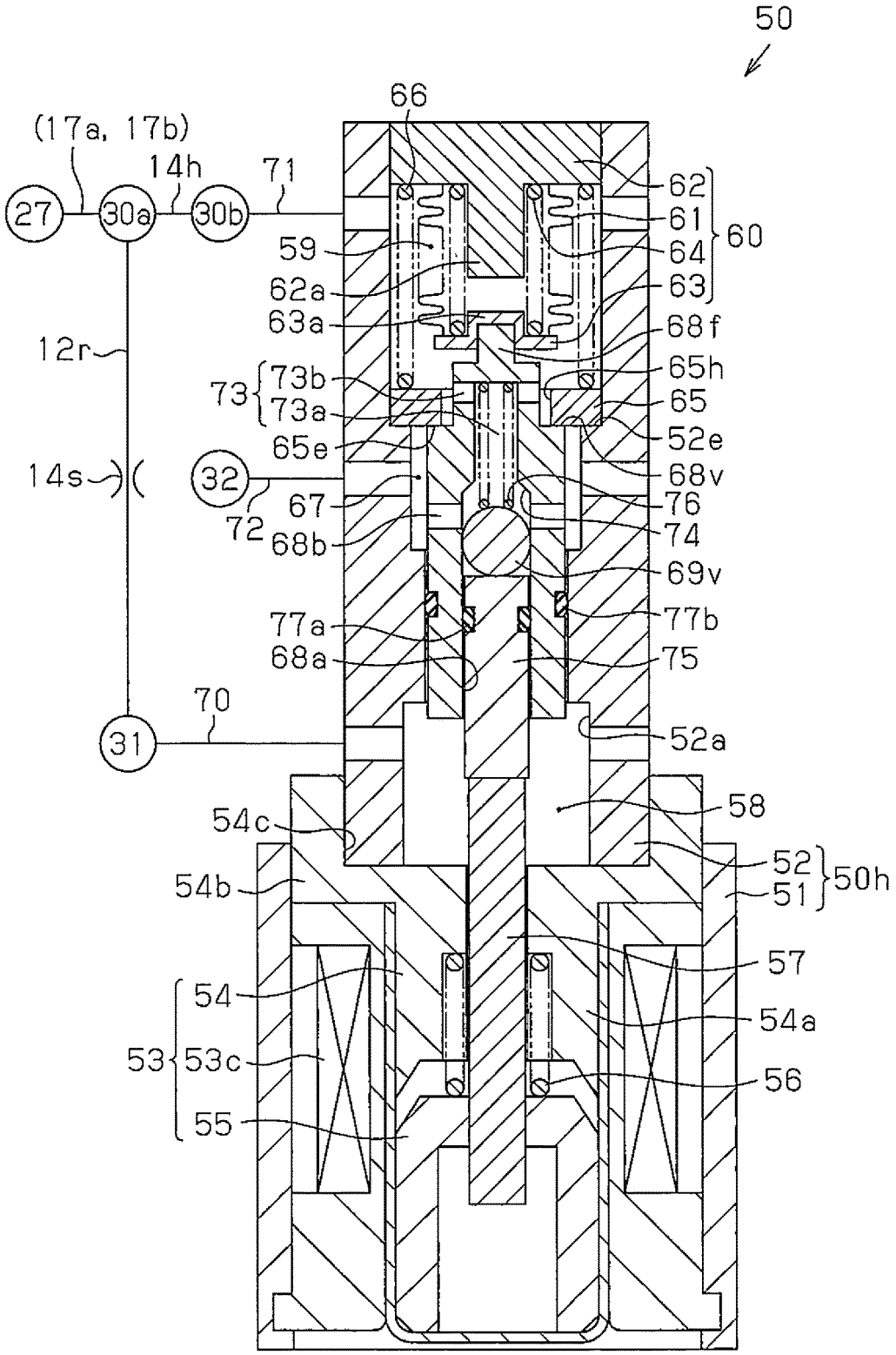
FIG. 5 is a sectional view of a capacity control valve when a pressure in a suction chamber is higher than a predetermined value.

As shown in FIG. 5, when the pressure in the suction chamber 31 is higher than a predetermined value due to stop of conduction to the electromagnetic solenoid 53 by turning off the air conditioner switch 50*s*, there is a case where the suction chamber 31 receives the pressure, the first valve body 68*v* is biased toward the bellows 61 by the pressure in the rear pressure chamber 58, and the first valve body 68*v* becomes in the closed state. Even in this case, the second valve body 69*v* is separated from the staged part 74 by the biasing force of the biasing spring 76. Therefore, the refrigerant gas is supplied from the discharge chamber 32 to the control pressure chamber 27 via the passage 72, the valve chamber 67, the communication opening 68*b*, the insertion hole 68*a*, the first passage 73*a*, the second passage 73*b*, the housing chamber 59, the passage 71, the second pressure adjusting chamber 30*b*, the communication hole 14*h*, the first pressure adjusting chamber 30*a*, the first shaft inner passage 17*a*, and the second shaft inner passage 17*b*. As a result, when conduction to the electromagnetic solenoid 53 has been stopped, the pressure in the control pressure chamber 27 becomes substantially equal to the pressure in the discharge chamber 32, and the inclination angle of the swash plate 19 is changed to the minimum inclination angle.

When conduction to the electromagnetic solenoid 53 has been performed again by turning on the air conditioner switch 50*s*, the variable displacement type swash plate compressor 10 is operated in the minimum discharge capacity. Therefore, increase in the load to the variable displacement type swash plate compressor 10 due to a sudden increase in the discharge capacity can be avoided.

In the case of obtaining driving force of the rotation shaft 17 from the engine E via the power transmission mechanism PT made of a clutchless mechanism, the following problem occurs. That is, even when conduction to the electromagnetic solenoid 53 has been stopped, the power of the engine E is consumed slightly, because the driving force is always being transmitted from the engine E to the rotation shaft 17 via the power transmission mechanism PT. Accordingly, in order to suppress as far as possible the power consumption by the engine E, it is preferable that the engine E be in the state of being operated in the minimum discharge capacity in which the inclination angle of the swash plate 19 is maintained at a minimum inclination, when conduction to the electromagnetic solenoid 53 is being stopped.

Therefore, when conduction to the electromagnetic solenoid 53 has been stopped, the refrigerant gas is supplied to the control pressure chamber 27 from the discharge chamber 32 via the intake air passage, by maximizing the opening degree of the first valve body 68*v*. In this way, the capacity control valve 50 controls the inclination angle of the swash plate 19 to become a minimum inclination angle, by setting the pressure in the control chamber 27 substantially equal to the pressure in the discharge chamber 32. However, when the pressure in the suction chamber 31 has increased and reached a predetermined value while conduction to the electromagnetic solenoid 53 has been stopped, the pressure in the rear pressure chamber 58 also becomes high. Accordingly, the first valve body 68*v* closes the intake air passage by the pressure in the rear pressure chamber 58.

In this respect, according to the present embodiment, the second valve body 69*v* is separated from the staged part 74 by the biasing force of the biasing spring 76, and the second valve body 69*v* becomes in the opened state. Therefore, the refrigerant gas is supplied from the discharge chamber 32 to the control pressure chamber 27 via the passage 72, the valve chamber 67, the communication opening 68*b*, the insertion hole 68*a*, the first passage 73*a*, the second passage 73*b*, the housing chamber 59, the passage 71, the second pressure adjusting chamber 30*b*, the communication hole 14*h*, the first pressure adjusting chamber 30*a*, the first shaft inner passage 17*a*, and the second shaft inner passage 17*b*. As a result, when conduction to the electromagnetic solenoid 53 has been stopped, the pressure in the control pressure chamber 27 becomes substantially equal to the pressure in the discharge chamber 32, and therefore, the inclination angle of the swash plate 19 is changed to the minimum inclination angle. Accordingly, in the configuration for obtaining the driving force of the rotation shaft 17 from the engine E via the power transmission mechanism PT made of a clutchless mechanism, even when the pressure in the suction chamber 31 has varied in the state that conduction to the electromagnetic solenoid 53 has been stopped, the inclination angle of the swash plate 19 is changed to the minimum inclination angle, the minimum inclination angle is maintained, and the operation in the minimum discharge capacity is securely performed. As a result, power consumption by the engine E can be minimized.

In the above embodiment, the following effects can be obtained.

(1) At a closing time of the second valve body 69*v*, the driving force of the driving force transmission member 57 is transmitted to the first valve body 68*v* via the second valve body 69*v*, so that the setting of the pressure sensing mechanism 60 that controls the opening degree of the first valve body 68*v* is changed. According to this configuration, when the second valve body 69*v* has been opened while conduction to the electromagnetic solenoid 53 has been stopped, the refrigerant gas from the discharge chamber 32 is supplied to the control pressure chamber 27 via the passage 72, the valve chamber 67, the communication opening 68*b*, the insertion hole 68*a*, the first passage 73*a*, the second passage 73*b*, the housing chamber 59, the passage 71, the second pressure adjusting chamber 30*b*, the communication hole 14*h*, the first pressure adjusting chamber 30*a*, the first shaft inner passage 17*a*, and the second shaft inner passage 17*b*. Accordingly, the pressure in the control pressure chamber 27 can be set substantially equal to the pressure in the discharge chamber 32. As a result, even when the pressure in the suction chamber 31 has varied while conduction to the electromagnetic solenoid 53 has been stopped, the inclination angle of the swash plate 19 can be changed to the minimum inclination angle, and the minimum inclination angle can be maintained.

(2) The biasing spring 76 that biases the second valve body 69*v* to a direction of opening the second valve body 69*v* is arranged between the first valve body 68*v* and the second valve body 69*v*. Further, when conduction to the electromagnetic solenoid 53 has been stopped, the second valve body 69*v* is opened by the biasing force of the biasing spring 76. According to this configuration, while conduction to the electromagnetic solenoid 53 is being stopped, the opened state of the second valve body 69*v* is securely maintained by the biasing spring 76. Therefore, operation in the minimum discharge capacity can be securely performed, and power consumption by the engine E can be minimized.

(3) The control pressure chamber 27 is formed between the lug plate 23 and the movable body 24. According to this configuration, the crank chamber 16 can be set as a suction pressure region, and a sliding portion can be smoothly slid by a lubricant that is included in the refrigerant gas which has been suctioned into the crank chamber 16. Further, at the time of suctioning the refrigerant gas from the suction opening 13*s* into the crank chamber 16, intake pulsation of the refrigerant gas can be suppressed, and noise can be suppressed.

(4) The variable displacement type swash plate compressor 10 obtains the driving force of the rotation shaft 17 from the engine E via the power transmission mechanism PT made of a clutchless mechanism. According to this configuration, as compared with the configuration for obtaining the driving force of the rotation shaft 17 from the engine E via the power transmission mechanism made of an electromagnetic clutch mechanism only during conduction to the electromagnetic solenoid 53, total weight of the variable displacement type swash plate compressor 10 and power consumption for operating the power transmission mechanism made of an electromagnetic clutch mechanism can be suppressed.

(5) Because the inclination angle of the swash plate 19 can be changed to the minimum inclination angle when conduction to the electromagnetic solenoid 53 has been stopped, the variable displacement type swash plate compressor 10 is operated in the minimum discharge capacity when conduction to the electromagnetic solenoid 53 has been performed again. Therefore, the increase in the load to the variable displacement type swash plate compressor 10 due to a sudden increase in the discharge capacity can be avoided.

(6) The inclination angle of the swash plate 19 can be changed by changing the pressure of the control pressure chamber 27 which is formed by the lug plate 23 and the movable body 24. The capacity of the control pressure chamber 27 is smaller than the capacity of the crank chamber 16. Therefore, the quantity of the refrigerant gas supplied to the control pressure chamber 27 can be small, and response at the time of changing the inclination angle of the swash plate 19 is satisfactory.

(7) The movable body 24 moves to the axial direction of the rotation shaft 17, based on the difference between the pressure in the control pressure camber 27 and the pressure in the crank chamber 16. As a result, the inclination angle of the swash plate 19 is changed. According to this configuration, the movable body 14 moves by sliding with the rotation shaft 17 and the lug plate 23 at the time of moving to the axial direction of the rotation shaft 17, and the sliding generates friction. Therefore, the pressure in the control pressure chamber 27 is controlled by taking the influence of the friction into account. For example, in operating in the minimum discharge capacity, it is necessary to supply the refrigerant gas to the control pressure chamber 27 by taking the influence of the friction into account. When conduction to the electromagnetic solenoid 53 has been stopped after turning off the air conditioner switch 50*s*, the refrigerant gas is supplied from the discharge chamber 32 to the control pressure chamber 27 by opening the first valve body 68*v*. In addition, the refrigerant gas is also supplied from the discharge pressure chamber 32 to the control pressure chamber 27 by opening the second valve body 69*v*. In this case, as compared with the case of supplying the refrigerant gas from the discharge chamber 32 to the control pressure chamber 27 by only opening the first valve body 68*v*, the flow quantity of the refrigerant gas from the discharge chamber 32 to the control pressure chamber 27 increases. Therefore, the pressure in the control pressure chamber 27 can be efficiently set nearer to the pressure in the discharge chamber 32.

(8) The first valve body 68*v* and the pressure sensing mechanism 60 are integrated. According to this configuration, even when the pressure in the housing chamber 59 has increased and the bellows 61 has been contracted, because the first valve body 68*v* is seated on the valve seat 65*e*, contraction of the bellows 61 following the increase in the pressure in the housing chamber 59 can be prevented. That is, it is not necessary to increase the biasing force of the spring 64 to prevent more than necessary contraction of the bellows 61. Therefore, it is not necessary to increase the biasing force of the spring 64, and it is not necessary to mount the large coil 53*c* that generates a larger electromotive force than the biasing force of the spring 64. Consequently, the capacity control valve 50 can be made small.

The above embodiment may be modified as follows.

The driving force transmission member 57 and the transmission rod 75 may be integrated.

The front end part of the transmission rod 75 may have the function of the second valve body. In this case, the second valve body 69*v* may be excluded.

The sectional area of the valve hole 65*h* and the effective pressure receiving area of the bellows 61 are not necessary to be completely the same, and may be approximately the same.

The driving force of the rotation shaft 17 may be obtained from an external driving source via a clutch.

The control pressure chamber 27 may not be formed between the lug plate 23 and the movable body 24.

The crank chamber 16 may be made to function as a control pressure chamber.

The invention clamed is:

1. A variable displacement type swash plate compressor comprising:

a housing having a crank chamber;

a rotation shaft which is arranged in the housing;

a swash plate that is housed in the crank chamber and rotates by driving force from the rotation shaft, wherein an inclination angle of the swash plate with respect to the rotation shaft is changed;

a piston that is locked to the swash plate;

a control pressure chamber that changes the inclination angle of the swash plate by supply and discharge of a refrigerant gas; and a capacity control valve that controls a pressure in the control pressure chamber, wherein the piston reciprocally moves by a stroke according to the inclination angle of the swash plate, and wherein the capacity control valve comprises:

an electromagnetic solenoid;

a driving force transmission member, which is driven by conduction of electricity to the electromagnetic solenoid;

a first valve body that controls an opening degree of an intake air passage, which extends from a discharge pressure chamber to the control pressure chamber, wherein a supply passage is formed in the first valve body and communicates between the discharge pressure chamber and the control pressure chamber by partially bypassing the intake air passage;

a second valve body that opens and closes the supply passage by driving force of the driving force transmission member; and a pressure sensing mechanism which is expanded and contracted in a moving direction of the first valve body by sensing a pressure in a suction pressure region to control an opening degree of the first valve body, and at a closing time of the second valve body, setting of the pressure sensing mechanism, which controls the opening degree of the first valve body, is changed by transmitting driving force of the driving force transmission member to the first valve body via the second valve body.

2. The variable displacement type swash plate compressor according to claim 1, comprising a biasing member that biases the second valve body in a direction of opening the second valve body, wherein the biasing member is arranged between the first valve body and the second valve body, and when conduction of electricity to the electromagnetic solenoid is stopped, the second valve body opens by a biasing force of the biasing member.

3. The variable displacement type swash plate compressor according to claim 1, further comprising:

a movable body which can change an inclination angle of the swash plate by moving to an axial direction of the rotation shaft, wherein the control pressure chamber is a space formed by partitioning an inside of the crank chamber by the movable body and when the refrigerant gas has been supplied to the control pressure chamber, the movable body moves in the axial direction of the rotation shaft.

* * * * *